US005365613A

United States Patent [19]

Henegan

[11] Patent Number: 5,365,613

[45] Date of Patent: Nov. 22, 1994

[54] HAIR DRYING TOWEL TURBAN

[75] Inventor: Kym Henegan, New York, N.Y.

[73] Assignee: Kymmania Enterprises, New York, N.Y.

[21] Appl. No.: 79,619

[22] Filed: Jun. 18, 1993

[51] Int. Cl.[5] ..... A42B 1/04

[52] U.S. Cl. ..... 2/174; 2/68; 2/171

[58] Field of Search ..... 2/68, 171, 174, 195, 2/198, 200, 207, 200.1; D6/608

[56] References Cited

U.S. PATENT DOCUMENTS

| | | | |
|---|---|---|---|
| D. 275,287 | 10/1984 | Henry . | |
| 770,338 | 9/1904 | Tooher . | |
| 1,144,121 | 6/1915 | Guinzburg | 2/68 |
| 1,146,829 | 7/1915 | Winget | 2/68 |
| 1,541,810 | 6/1925 | Hamilton | 2/68 |
| 1,569,942 | 1/1926 | Barnhill . | |
| 1,698,533 | 1/1929 | Brown | 2/174 |
| 1,742,314 | 1/1930 | Husman | 2/68 |
| 1,819,558 | 8/1931 | Husman | 2/68 |
| 1,920,387 | 8/1933 | Harper | 2/68 |
| 2,263,418 | 11/1941 | Ganim | 2/198 |
| 2,279,867 | 4/1942 | Falk . | |
| 2,336,356 | 12/1943 | Harding | 2/198 |
| 2,363,198 | 11/1944 | Paull | 2/198 |
| 2,417,323 | 3/1947 | Richards | 2/68 |
| 2,497,892 | 2/1950 | Klar | 2/68 |
| 2,568,399 | 9/1951 | Kahn | 2/174 |
| 2,653,326 | 9/1953 | Ged | 2/198 |
| 2,694,204 | 11/1954 | Cross | 2/174 |
| 2,804,695 | 9/1957 | Scott . | |
| 2,831,197 | 4/1958 | Spells | 2/198 |
| 2,970,318 | 2/1961 | Nordling . | |
| 3,238,536 | 3/1966 | Gettinger | 2/207 |
| 3,268,913 | 8/1966 | Gettinger | 2/198 |
| 3,480,970 | 12/1969 | Gettinger | 2/207 |
| 3,541,610 | 11/1970 | Gettinger | 2/207 |
| 4,788,722 | 12/1988 | Oliver | 2/207 |
| 5,083,318 | 1/1992 | Hook | 2/207 |
| 5,161,260 | 11/1992 | Reynolds | 2/207 |

FOREIGN PATENT DOCUMENTS

| | | | |
|---|---|---|---|
| 652910 | 5/1951 | United Kingdom | 2/68 |

*Primary Examiner*—Clifford D. Crowder
*Assistant Examiner*—Diana L. Biefeld
*Attorney, Agent, or Firm*—Levisohn, Lerner & Berger

[57] ABSTRACT

A hair drying turban made from a single piece of absorbent cloth and having a cap portion and, extending forwardly, a hair basket portion. In use, the wearer places the cap portion on his or her hair with the hair extending forwardly over the forehead and face (the wearer bending at the waist). Then, with the hair placed neatly within the hair basket portion, the hair basket is twisted about the longitudinal axis of the hair. The hair basket portion is then folded backwardly along the center line of the cap portion and secured to the back of the cap portion. A loop is provided for allowing the turban to be easily hung on a door peg and/or, alternatively, to facilitate the tucking in of the hair basket portion beneath the cap portion.

16 Claims, 1 Drawing Sheet

HAIR DRYING TOWEL TURBAN

BACKGROUND OF THE INVENTION AND DESCRIPTION OF THE PRIOR ART

The present invention relates to an accessory for use in hair-drying operations following hair and scalp treatment in the home, beauty parlors, hair dressing establishments or the like, or for use at beaches, pools, bathing establishments, or wherever it is desired to dry, at least partially, the hair after wetting thereof. It is also intended to be used by women with long hair who desire, after showering or bathing, to keep their wet hair above their heads, off of their shoulders and backs. As the hair dries, the user can dress and/or put on make-up without the wet hair getting in the way or wetting clothing. Customarily, it is the current practice to effect such drying by wrapping the hair in a rectangular-shaped bath sheet or towel which is then hand-manipulated into a turban-like headdress. The cloth of the turban contacts the hair and is worn until the hair has at least partially dried to an extent that it is manageable, or, alternatively, while the individual otherwise gets dressed after the shower. However, the wrapping of a towel or other rectangular-shaped drying fabric into a turban-like headdress requires considerable manual dexterity and practice in order to provide a sufficiently tight fit about the wearer's head and hair. If not performed correctly, accidental unwrapping and/or displacement will quickly occur. In any event, movement of one's head, with the conventional turban-like towel, often results in the turban coming undone. That is obviously troublesome and a result to be avoided. Substantial amounts of time are thus consumed by those with long hair who desire the advantages of the turban-like towel wrap. Much time is spent in the wrapping and rewrapping of the conventional turban-like headdress. Primarily, this is due to the fact that the rectangular-shaped towel is much larger than needed for drying only the hair and the towel not ideally suited or shaped for wrapping of one's head and hair nor suitable for holding it above the head. The present invention, therefore, is directed to a hair drying towel/turban, preferably made from water absorbent cloth (terry). It is constructed to fit over the head and wet hair. When the towel/turban is manipulated properly, it creates a turban with the hair contained therein, located and secured on top of the head. It is very easy to apply and remove, as desired.

Accordingly, it is an object of the present invention to provide a hair-drying towel/turban which is ideally shaped and sized for use on one's head. Thee device is extremely easy to use, convenient and light-weight. It is a highly efficient drying device for the hair. At least partial drying of the hair is accomplished. Use of the device results in the hair being manageable for further drying operations, if desired. The device allows the user, if desired, to perform other tasks, e.g., applying make-up, donning clothing, other chores, etc.

The present invention relates to a hair-drying towel/-turban which can be easily hand-manipulated to contain and wrap the hair, after a wetting, to allow the hair to at least partially dry, or, alternatively, to allow the user to do other chores while the hair is wrapped and drying. The present invention is extremely easy to manipulate, and, indeed, it uses familiar hand movements to those used by current users of full bath sheets, wrapped into a conventional turban. Therefore, it requires little new training for users. It can even be used by teenagers and small children.

U.S. Pat. No. 2,694,204 shows a hair drying and protective turban having two ends which, according to the specification, are twirled, one about the other, in a relatively complicated hand moving manner. Then, according to the specification, the ends 10 and 11 are passed through eyelets 12 and 13. The ends are tied together behind the neck of the wearer (See FIG. 5). The present invention, as will be more fully explained hereinafter, is far easier to apply and requires far less manual dexterity to ensure securement above the wearer's head. The present device is to be contrasted with the '204 patent which requires tying ends together; rather, the single free end of the present invention is tucked under the head cowl portion to secure it in place.

U.S. Des. Pat. 275,827 shows a hooded towel, This patent neither teaches nor suggests the manner by which it is intended to be secured to one's head. It is believed that the use of the hooded towel shown in the '827 patent does not result in substantially all of the hair being held above the wearer's head, in a secure manner so as to enable, at least in part, the hair to dry. The procedure for wrapping the hooded towel does not appear to track that currently employed for securing a bath sheet as a turban.

U.S. Pat. No. 770,338 shows a bathing cap. It does not teach nor suggest the use of an absorbent cloth-like material which is intended to be worn in a turban-like manner to facilitate drying of the hair. Rather, the bathing cap of the '338 patent seems to be directed to preventing the hair from becoming wet. Also, the bathing cap requires that long length hair be massed directly on top of the head. The present invention wraps the long length of hair in a towel-like fabric and overlays the long hair on a towel covered portion on the head. Hair massing and entanglement is avoided.

U.S. Pat. No. 5,161,260 relates to an article of athletic wear. It neither teaches nor suggests wrapping hair in an absorbent cloth and holding it above the wearer's head. Rather, the device allows the wearer's hair to flow freely behind and down the neck of the individual, with only the top portion of the hair being covered.

U.S. Pat. No. 4,788,722 shows a fabric fashion accessory which is primarily used as a scarf. FIG. 14 shows that the scarf can also be used as a head covering. Here, again, formation of the scarf into a head covering requires quite a bit of manual dexterity, and, in addition, requires tying of the two ends into some form of knot or bow. The present invention, on the other hand, is extremely simple to use and utilizes the same manner of hand movement as is currently used by those who employ bath sheets for wrapping their hair into a turban. The present invention is far simpler to use than the scarf of the '722 patent.

U.S. Pat. No. 3,541,610 relates to a head scarf and, again, requires that two ends be tied together to secure the same beneath the neck of the wearer. U.S. Pat. No. 5,083,318 also relates to a scarf-like device for wrapping the head and, again, requires that the two free ends be tied together into a knot or bow to secure the same. U.S. Pat. No. 3,480,970 relates to a reversible head scarf with a rain visor, and, again, requires that the two free ends of the device be tied together beneath the wearer's chin to hold the scarf on the head. U.S. Pat. No. 3,238,536 relates to a head scarf which is intended to be secured beneath the wearer's chin and, again, requires that the two free ends be wrapped together to secure the same. The present invention uses a single free end for wrapping the hair and securing the same in place. It is far easier to use than the prior art devices which require manipulation of two free ends and tying the ends together.

Many of the above listed prior art patents necessitate that the device be secured beneath the wearer's chin. Clearly, this is a disadvantage. The present invention, on the other hand, allows for the hair drying turban to be secured, in place by folding a single free end over the top of the head and tucking it beneath the head cowl portion of the device, behind the wearer's head. This, therefore, allows the chin to be unencumbered. This is a significant advantage especially for those who are trying to get dressed while their hair is at least partially drying and, further, removes an uncomfortable piece of cloth from beneath the wearer's chin.

U.S. Pat. No. 2,804,695 relates to a bonnet-like device for drying wet hair and utilizes elastic-like material about its perimeter edge to secure the same over the scalp. If this device were employed by those with long hair, the hair would simply be massed together beneath the cap and on top of the head. This might lead to hair entanglement, especially if the user has long hair. On the other hand, the present inventive turban is effective for use by those with both short and long hair. The hair is held longitudinal, free of entanglement, in a manner well known by those who have formed and used ordinary bath sheets into a drying turban. The long hair is separately wrapped and overlaid over the hair, separated from the hair close to the scalp by a separate layer of cloth. U.S. Pat. No. 2,653,326 shows a turban cap having two ends which are adapted to be tied together into a bow above the forehead of the individual. U.S. Pat. No. 2,363,198 is quite similar to the '326 patent and also shows a turban. A method of fabrication of the turban is also shown. This patent too, shows two free ends which are intended to surround the head in a variety of ways to suit the fancy of the wearer. The cowl of this turban may then be drawn together and formed by a short drawstring running through and gathering together the material running from the prow 28 of the cowl 11 about half way to what is called the crotch 17. The present invention, as will be more fully described hereinafter, is different. It uses a single hair holding basket to entwirl the hair and hold the same, tangle free, i.e., longitudinally directed away from the scalp. Only one end is twisted, by simple and familiar hand movements to secure it in place.

U.S. Pat. No. 2,336,356 shows a head covering having two flee ends which are intended to be wrapped around and secured to one another or, alternatively, tucked beneath the remainder of the head covering so as to secure the same in place. Again, the hand manipulation required for securement of this device seems significantly more complicated than that contemplated by the present invention. The hand movement required for the present invention substantially corresponds to the hand movement currently used by those who employ ordinary bath sheets as hair-drying turbans.

U.S. Pat. No. 2,279,867 shows a hair net which is secured in place by loops 5 and 6 being secured over center button 4. This, device requires that two free ends be attached to secure the hair net.

U.S. Pat. No. 1,920,387 shows a bathing cap for swimmers and, again, requires that the tying extensions 7 be secured to one another to form a bow or knot 8. This requires manual dexterity which can be difficult, especially if the operations are above the head.

U.S. Pat. No. 1,819,558 shows a cap. The free ends must be tied into a knot, beneath the wearer's chin or, alternatively, tabs 8, a ring 9 and a hook 10 cooperate to secure the same in place behind the wearer's head. Clearly, this is difficult to accomplish by an individual, especially an elderly one or a child.

U.S. Pat. No. 1,742,314 also relates to a bathing cap. Tabs 7 are provided with separable components of a snap fastener 8 which cooperate to secure the same in place. This seems difficult to coordinate especially since the two ends are located behind one's head.

U.S. Pat. No. 1,569,942 shows a reversible hat and has two free ends which cooperate to secure the same in place. Specifically, the free end of one end is passed through a slot located in the other end. Here, again, this device, used by those with long hair will result in hair entanglement.

U.S. Pat. No. 1,541,810 shows a bathing cap, again, having two free ends which are intended to be tied together into a bow behind the wearer's head. The same disadvantages previously discussed with respect to similar devices are equally applicable here. U.S. Pat. No. 1,146,829 also shows a bonnet and, again, has two strings or ribbons, 8 and 9, which are adapted to facilitate holding the bonnet in place on the wearer's head. U.S. Pat. No. 2,497,892 shows a cap also having a pair of free ends, adapted to be tied together to secure it in place.

U.S. Pat. No. 1,144,121 shows a bathing cap with elastic loops 6 which are adapted to be secured over a button 3 located above the forehead of the wearer. Here, again, this device necessitates the hand manipulation of two free ends of the device to secure it. U.S. Pat. No. 2,970,318 shows a hood with multiple snaps. It, too, will result in hair entanglement for those having long hair since the hair is massed on top of the head.

SUMMARY OF THE PRESENT INVENTION

The present invention is an absorbent cloth, formed into a head covering portion and a contiguous hair basket and twirling portion. The cap-shaped section for the head is adapted to be placed over the wet or dry head of a person, snugly fitting about the head and hair by elastic. If applied to a dry head the device serves to protect the hair from getting wet during bathing. The hair basket portion extends forwardly. With the wearer having his or her long hair directed, not behind the shoulders, towards and down the back, but, rather, over and forwardly the face and forehead, the hair basket portion is then twisted with the hair cradled and contained therein. Then, the hair basket portion, with the hair twirled within, is folded backwardly, over the center of the wearer's head, with the tip of the hair basket portion then being tucked underneath the cap portion (near the nape of the neck) to secure the same in place.

In the preferred embodiment, the absorbent turban is placed over the back of the head with the aesthetic bow basically located above the nape of the neck. The hair basket extends forwardly. Then, the hair basket portion, is twirled, much in the same manner as individuals currently twirl normal bath sheets or towels with the hair contained therein. The now-twirled hair basket portion is brought back over the top of one's head such that the tip of the hair basket portion is capable of being tucked under the bow of the rear of the cap portion.

The turban is elasticated, about the perimeter of the cap portion, so that it conforms to the side edges, shape and size of the head. It is lightweight, soft and extremely comfortable. When secured, the turban will not fall off even as one moves about quite vigorously. It is extremely small and compact so as to allow the wearer to dress, substantially entirely, including slipping a dress over one's head. This, of course, is not easily done with the conventional prior art, full size bath sheet which is twisted and made into a hair drying turban.

Use of the present turban eliminates the use of full size bath sheets or towels for the same purpose. Furthermore, the large towels, when twisted and then wrapped on the top of the head, often fall off as one moves about. In addition, the present invention can be used as an alternative to a shower cap so as to avoid or at least reduce wetting of the hair during bathing. The present invention is extremely useful for hot oil treatments, conditioning one's hair, as well as facial or beauty treatments in that it protects the hair or, alternatively, as mentioned, it absorbs the water contained in the hair.

Briefly stated, the present invention comprises a cap portion or head engaging section and a hair basket or twirling section, extending forwardly therefrom. The cap portion is secured over the head. The long hair is then put in to the hair basket and the hair and basket portion twirled about the longitudinal axis of the hair. Even short haired persons can use the present invention for drying and/or preventing the hair from getting wet. The hair basket is then tucked under the rear of the cap portion with the hair and basket portion extending backwardly and down the center line of the head.

Figure 1:
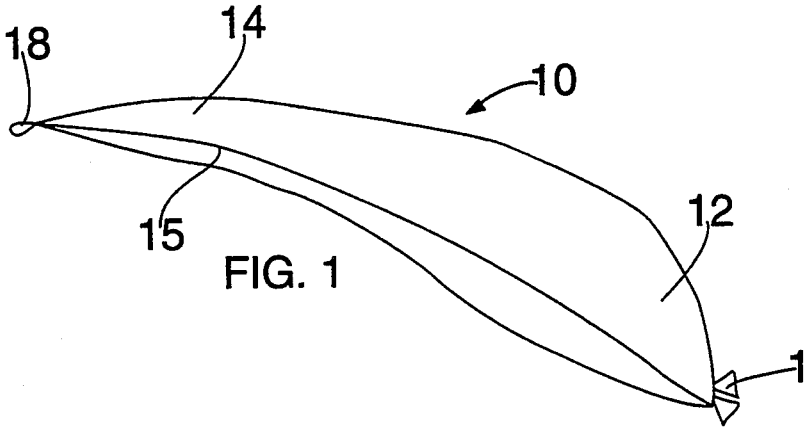
FIG. 1 is a perspective view of the present invention. Both sides are identical in size and shape and are sewn or connected together by a center seam extending from bow to front loop. The two sides are mirror images of one another.
Figure 2:
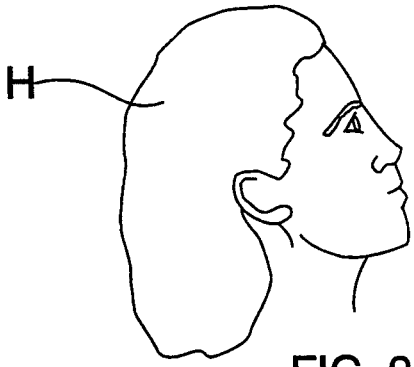
FIG. 2 is a side elevational view of a user, having wet hair, prior to donning the present invention.
Figure 3:
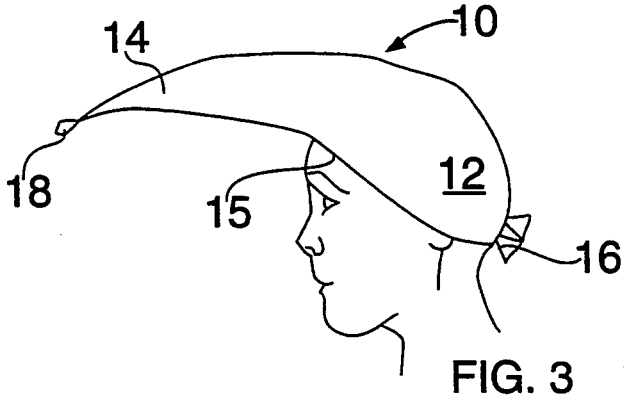
FIG. 3 is a side elevational view showing the present invention as intended to be initially placed on a wearer's head.

DETAILED DESCRIPTION OF THE DRAWINGS, THE PRESENT INVENTION AND THE PREFERRED EMBODIMENT

The present invention is best shown in the Figures of the drawings. Basically, the present invention, a hair drying turban/towel 10 comprises a piece of cloth-like material, preferably, terry cloth for absorbent purposes, cut and sewn into a cap portion 12 having, extending forwardly therefrom, a long hair basket portion 14. The cap and long hair basket portions are provided, about their perimeters, extending from bow 16, along one edge to the front loop 18 and then around the other edge with elastic 15 so that the cap portion 12 basically conforms to the wearer's head. Located at the rear and center of the cap portion 12 is a bow 16 which is not only aesthetic but, in addition, facilitates, as will be explained, the alignment and tucking in of the hair basket portion 14, at the nape of the neck beneath the cap portion 12.

Figure 4:
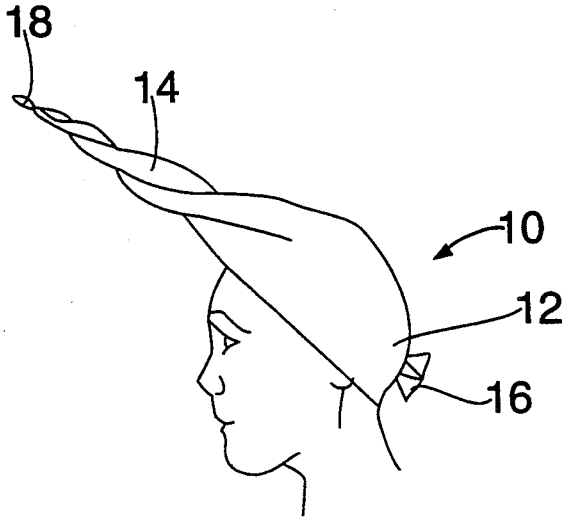
FIG. 4 is a side elevational view similar to that of FIG. 3, but now showing the hair basket portion of the present invention, with the user's hair contained therein, after it has been manually twisted about the axis of the hair.

When a wearer has the cap portion 12 placed over his or her hair and then leans forwardly such that the hair extends down over the face and forehead, the wearer's hair can easily be placed within the basket-like portion of the hair basket 14. Then, with the hair held within the hair basket portion 14, the wearer simply grips the two sides of the hair basket portion 14 and with either one or both hands twirls the hair and hair basket portion about an axis aligned with the hair. This is best shown in FIG. 4.

The distal tip of the hair basket portion 14 is provided with a loop 18. Loop 18 is provided for allowing the turban device to be easily hung up on a hook behind a bathroom door. This ensures that the device is easily accessible for use. In addition, the loop 18, after the hair basket and hair are twirled, allows for the hair and hair basket to be held in place, folded backwardly and down the center line of the head, with the loop 18, tucked under the rear portion of the cap portion 13, beneath the bow 16. This, then, secures the hair basket portion 14 with the hair H therein, extending down the center line of the head. The cap portion and hair basket portion with hair H are held in place so that the wearer can move about while the hair is contained within the drying turban.

Figure 5:
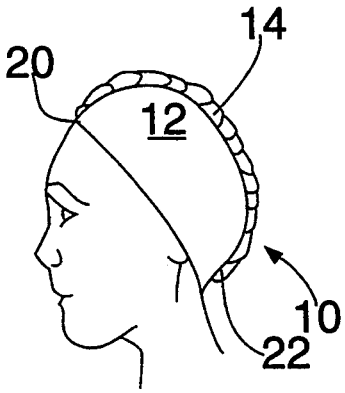
FIG. 5 is a side elevational view showing the present invention on a wearer's head, after the hair basket portion has been folded backwardly and tucked beneath the bow of the cap portion, above the nape of the neck. This figure shows the wearer with the turban in place.

The length of the hair basket portion is generally of sufficient dimension to both contain the long hair in a tangle free manner and, in addition, in the preferred embodiment, to allow the loop 18 to be tucked into the cap portion 12, Alternatively, the hair basket portion can be of a shorter length and secured to the top of the cap portion by any conventional fastener. As seen in FIG. 5, the length of the hair basket portion, when twisted a few times, is slightly greater than the length of the cap portion 12, extending from the forehead segment 20 to the nape segment 22.

An alternative embodiment of the invention could have a plastic liner for the cap and/or basket portion for hair treatment purposes. In this case the device could also be used as a water protector during bathing, if the plastic liner is situated facing out and the terrycloth side in contact with the hair.

Having described the invention with regard to a certain specific and preferred embodiment, it is understood that the description, including the drawings, are not meant as limitations but rather further modifications may suggest themselves to those skilled in the art. It is intended that the appended claims cover such modifications.

I claim:

1. A hair drying turban made of a water absorbent material comprising a cap portion and a forwardly extending hair basket portion, said hair basket portion being tapered from said cap portion to a single pointed free end at which side edges of said hair basket portion intersect, said free end of said hair basket portion being capable of being twisted about its center axis and folded backwardly over said cap portion and over the center axis of said cap portion, as well, and secured thereto, said hair basket portion being only of sufficient length so that the entire hair basket portion, after twisting and folding backwardly, extends from said forward portion of said cap portion to the rear portion of said cap portion.

2. A hair drying turban as claimed in claim 1 wherein the length of said hair basket portion, after several twists about said center axis, is slightly greater than the circumferential distance of the cap portion from forehead segment to nape segment.

3. A hair drying turban as claimed in claim 2 wherein said cap portion and said hair basket portion are made from an absorbent cloth-like material.

4. A hair drying turban as claimed in claim 3 wherein said tip of said hair basket portion is provided with securement means for securing said hair basket portion to the rear of said cap portion.

5. A hair drying turban as claimed in claim 1 wherein said cap portion and said hair basket portion are made from an absorbent cloth-like material.

6. A hair drying turban as claimed in claim 1 wherein said tip of said hair basket portion is provided with securement means for securing said hair basket portion to the rear of said cap portion.

7. A hair drying turban as claimed in claim 5 wherein said securement means is a loop.

8. A hair drying turban as claimed in claim 1 wherein said securement means is a loop.

9. A hair drying turban as claimed in claim 1 wherein said tip of said hair basket portion is provided with securement means for securing said hair basket portion to the rear of said cap portion.

10. A hair drying turban as claimed in claim 1 further comprising centering means for enabling a wearer to locate with their fingers the rear and center of said cap portion.

11. A hair drying turban as claimed in claim 1 further comprising centering means for enabling a user to locate with their fingers the rear and center of said cap portion.

12. A hair drying turban as claimed in claim 1 further comprising centering means for enabling a user to locate with their fingers the rear and center of said cap portion.

13. A hair drying turban as claimed in claim 12 wherein said centering means is a bow.

14. A hair drying turban as claimed in claim 1, wherein said hair drying turban is provided with an elastic border.

15. A hair drying turban as claimed in claim 1, wherein said cap portion is lined with a sheet of water-impervious material.

16. A hair drying turban as claimed in claim 1 wherein said hair basket portion is lined with a sheet of water impervious material.

* * * * *